US007266322B2

(12) United States Patent
Swift et al.

(10) Patent No.: US 7,266,322 B2
(45) Date of Patent: Sep. 4, 2007

(54) MULTI-FUNCTIONAL ELECTRO-MECHANICAL INTERCONNECT, SENSOR, AND MOUNTING AND METHOD OF MOUNTING AND BIASING OF A ROTATABLE MEMBER

(75) Inventors: Joseph A. Swift, Ontario, NY (US); Stanley John Wallace, Victor, NY (US); Richard Seyfried, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 251 days.

(21) Appl. No.: 11/094,424

(22) Filed: Mar. 31, 2005

(65) Prior Publication Data

US 2006/0228923 A1 Oct. 12, 2006

(51) Int. Cl.
*G03G 15/00* (2006.01)

(52) U.S. Cl. ..... 399/90

(58) Field of Classification Search ..... 399/37; 492/10; 439/87

See application file for complete search history.

(56) References Cited

U.S. PATENT DOCUMENTS 4,641,949 A 2/1987 Wallace et al.
4,741,942 A 5/1988 Swift
5,420,465 A * 5/1995 Wallace et al. ..... 307/116
5,812,908 A * 9/1998 Larocca et al. ..... 399/90
5,843,567 A 12/1998 Swift et al.
5,885,683 A 3/1999 Swift
5,887,225 A * 3/1999 Bell ..... 399/90
6,214,921 B1 4/2001 Bluett et al.
6,265,046 B1 * 7/2001 Swift ..... 428/88
6,444,102 B1 9/2002 Tucci et al.
6,794,984 B2 9/2004 Komatsu
2006/0165428 A1 * 7/2006 Hasegawa ..... 399/69

* cited by examiner

*Primary Examiner*—David M. Gray
*Assistant Examiner*—David A Blackshire
(74) *Attorney, Agent, or Firm*—Oliff & Berridge, PLC

(57) ABSTRACT

An interconnect includes a first contact portion including carbon fibers, a second portion including carbon fibers, and a member. The first contact portion is capable of electrically biasing the member and the second portion is capable of sensing an electrical bias of the member. Both portions may provide other electrical functions. Both portions may structurally support the member.

29 Claims, 10 Drawing Sheets

MULTI-FUNCTIONAL ELECTRO-MECHANICAL INTERCONNECT, SENSOR, AND MOUNTING AND METHOD OF MOUNTING AND BIASING OF A ROTATABLE MEMBER

CROSS-REFERENCE TO RELATED APPLICATION

The entire disclosure of co-pending U.S. patent application Ser. No. 11/094,407 is hereby incorporated by reference herein in its entirety.

BACKGROUND

Printing and copying processes use a wide range of contacts and devices for mechanical and/or electrical connection. Printing and copying processes, such as are used in printing and copying machines, extensively employ methods and apparatus using electrical charge to perform many operations. For example, development, transfer and cleaning operations of most printing and copying machines require the transfer of electrical current, e.g., for manipulating electrostatic charge.

A part of a printing process is discussed below. A printing machine may have a photoconductive member that is electrically charged to a uniform potential and thereafter exposed to a light image of a document to be reproduced. The exposure discharges the photoconductive insulating surface of the member in exposed or background areas and creates an electrostatic latent image on the member, which corresponds to the image contained within the original document. The electrostatic latent image on the photoconductive surface is made visible by developing the image with developer powder, e.g., toner. Many development systems employ developer, which includes both charged carrier particles and charged toner particles, which adhere to the carrier particles. During development, the toner particles are attracted from the carrier particles by the charged pattern of the image areas of the photoconductive insulating area to form a powder image on the photoconductive area. The toner image may be subsequently transferred to a support surface, e.g., a sheet of paper, to which it may be permanently affixed.

A specific member, e.g., the photoconductive member discussed above, is electrically charged by transferring an electrical charge to the specific member. This transfer of charge to a member may be referred to as charging or as biasing the member. The bias of a member corresponds to the voltage applied to the member, or to the voltage potential of the member.

A sliding contact may be used as a member to bias, i.e., to transfer an electrical charge to, a rotating member, such as the photoconductive member discussed above. For example, U.S. Pat. No. 5,887,225 to Bell, the disclosure of which is incorporated herein by reference in its entirety, discloses a charge transfer device that is in electrical contact with end shafts of first and second developer rolls of a copier through a sliding electrical contact. The charge transfer device biases the rolls by transferring an electrical charge from a voltage source to the end shafts of the developer rolls via the sliding electrical contact. Other methods of transferring an electrical charge either to or from a member include placing the member to be biased in rubbing contact with a stationary brush, a flexible electrically conductive sheet, or a metal strip.

As discussed above, U.S. Pat. No. 5,887,225 to Bell discloses a charge transfer device including a sliding contact that transfers electrical charge between a voltage source and a developer roll. In Bell, the sliding contact is formed of a polymer composite of multiple electrically conductive carbon fibers. An example of a carbon fiber polymer composite is known by the trade name CarbonConX™. CarbonConX™ has a high concentration (e.g., >60% weight) of electrically conductive, high strength, continuous carbon fiber tow (or optionally metalized carbon fiber tow) compounded within a selected polymer matrix. Carbon fiber polymer composites may be used as an alternative to metal contacts in devices for electrostatic discharge applications as well as other application areas, such as sensor components, moving rotational contacts, motors, electrical switch components, etc. Applying pultrusion methods to produce the carbon fiber composites enables high strength to be obtained and allows many forms of the carbon fiber to be manufactured into various design shapes and configurations, such as, solid rods, tubes, and thin flat sheets. Moreover, the carbon fibers or metalized carbon fibers used in carbon fiber polymer composites are considered, generally, to be of high electrical conductivity as well as high strength and capable of providing statistically regular and evenly distributed electrical contact sites for charge conduction across an interface. Pultrusion methods involve, e.g., (1) pulling continuous lengths of members, such as fibers, through a host matrix material, such as a polymer, to form a composition, (2) pulling the composition through a die to shape the composition, and (3) pulling the composition through a heated region to enable the composition to cure, (e.g. cross-link) or dry.

Moreover, the carbon fibers used in carbon fiber polymer composites are considered, generally, as contact rich and capable of providing statistically regular and evenly distributed electrical contact sites. In addition, because carbon is generally non-reactive and less susceptible to corrosion when compared to other materials, such as, e.g., metal, carbon fiber may be used in harsh environments or corrosive environments, including saltwater, nuclear power environments, space, medical, and biological fields.

SUMMARY

It is desirable to form an integrated electrical interconnect with improved reliability, fewer number of parts, reduced manufacturing costs and simplified overall design. Exemplary embodiments provide apparatus, methods and systems for a multi-functional electromechanical integrated interconnect, sensor, and mounting, and a method of mounting and electrically biasing and/or sensing the electrical bias of a member.

Exemplary embodiments provide an interconnect including a first contact portion, a second contact portion, and a member, the first contact portion capable of electrically biasing the member and including carbon fibers, the second contact portion capable of transferring an electrical bias of the member to a sensor and including carbon fibers, and the first contact portion and the second contact portion contacting the member.

Exemplary embodiments provide an interconnect, wherein the first contact portion and the second contact portion each provide a force greater than 10 grams which acts to structurally support the member.

Exemplary embodiments provide an interconnect, wherein the first contact portion and the second contact portion each provide a force greater than 50 grams which acts to structurally support the member.

Exemplary embodiments provide an interconnect, wherein the first contact portion and the second contact portion form an arcuate structural support.

Exemplary embodiments provide an interconnect, wherein the second contact portion includes the sensor.

Exemplary embodiments provide an interconnect, wherein one of the first contact portion or the second contact portion includes an electrical circuit for performing a function other than electrically biasing the member or transferring the electrical bias of the member to the sensor.

Exemplary embodiments provide an interconnect, wherein the first contact portion is connected to a voltage source.

Exemplary embodiments provide an interconnect, wherein the first contact portion and the second contact portion tangentially contact the member.

Exemplary embodiments provide an interconnect, wherein the first contact portion and the second contact portion are integrated into a support member, and the first contact portion, second contact portion, and the support member contact the member.

Exemplary embodiments provide an interconnect, wherein the first contact portion and the second contact portion are electrically connected to the member and are not directly connected to each other.

Exemplary embodiments provide an interconnect, wherein at least one of the first contact portion or the second contact portion is electrically connected to the member and a second member.

Exemplary embodiments provide an interconnect, wherein the member is capable of movement relative to the first contact portion and the second contact portion.

Exemplary embodiments provide an interconnect, wherein the first contact portion, the second contact portion and a third contact portion substantially prevent movement of the member in a radial direction of the member.

Exemplary embodiments provide an interconnect, wherein greater than 50% by weight of the first contact portion and greater than 50% by weight of the second contact portion is carbon fibers.

Exemplary embodiments provide an interconnect, wherein the member contains at least two areas electrically isolated from each other.

Exemplary embodiments provide an interconnect, wherein the carbon fiber is a component of a composite and is retained in a thermoplastic or thermosetting polymer.

Exemplary embodiments provide an interconnect, wherein the composite contains a metal.

Exemplary embodiments provide a xerographic device including an interconnect.

Exemplary embodiments provide an interconnect including a contact portion, a support portion, a first member, and a second member, wherein: the contact portion tangentially contacts the first member and is embedded in the support portion, at least at two locations; the support portion structurally supports the contact portion and the first member, the contact portion is electrically connected to both the first member and the second member, the contact portion, the support portion, the first member, and the second member are fastened together to form an integral unit, and the contact portion locks the member from substantial movement in an axial direction of the first member.

Exemplary embodiments provide an interconnect, wherein the contact portion is capable of at least one of: applying an electrical bias to the first member and to the second member, or transferring the electrical bias of the first member and the electrical bias of the second member to a sensor.

Exemplary embodiments provide an interconnect including: a support member that supports a load of a rotatable member, a contact portion held by the support member, the contact member contacting the rotatable member, and capable of at least one of electrically biasing the rotatable member or transferring an electrical bias of the rotatable member to a sensor, wherein the contact portion locks the rotatable member from movement relative to the support member in at least an axial direction of the rotatable member.

Exemplary embodiments provide an interconnect including a first contact portion, a second contact portion, and a member, the first contact portion capable of influencing a characteristic of the member and including carbon fibers, the second contact portion capable of transferring a characteristic of the member to a sensor and including carbon fibers, and the first contact portion and the second contact portion contacting the member.

Exemplary embodiments provide an interconnect, wherein the influenced characteristic is at least one of vibration, temperature, or voltage.

Exemplary embodiments provide an interconnect, wherein the sensor is capable of sensing more than one characteristic of the member.

Exemplary embodiments provide an interconnect, wherein the sensor is capable of sensing at least one of vibration, temperature, or voltage.

Exemplary embodiments provide a method of electrically interconnecting a contact portion and a member, including: urging the contact portion including carbon fibers, against the member, the contact portion applying a force to the member to hold the first portion in electrical contact with the member, while preventing the member from substantial movement in an axial direction of the member.

These and other features and advantages of the invention are described in or are apparent from the following detailed description of the systems, methods and apparatus of various exemplary embodiments.

BRIEF DESCRIPTION OF THE DRAWINGS

Exemplary embodiments will be described in detail, with reference to the following figures in which like reference numerals refer to like elements, and wherein.

DETAILED DESCRIPTION OF EMBODIMENTS

Figure 1:
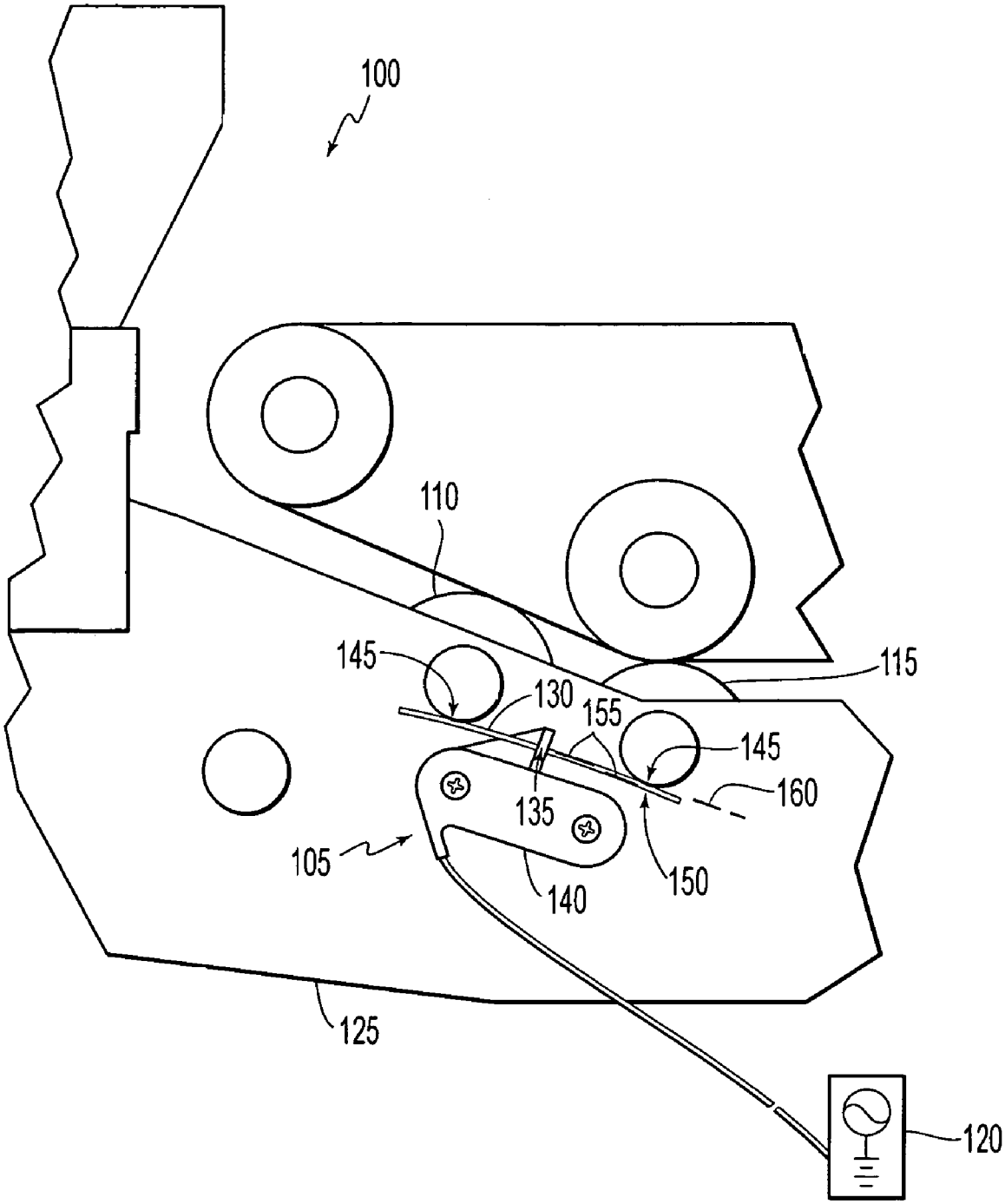
FIG. 1 PRIOR ART
FIG. 1 illustrates an exemplary embodiment of a developer unit including a charge transfer device using an electrical contact to transfer electrical bias to a developer roll within the developer unit.

Many devices, throughout a range of industries, employ mechanically actuated mechanisms, such as, e.g., springs, rockers, cams, pivotal levers, rollers, etc., to provide motioning, e.g., opening and closing, relative rotation or the like of device elements, or to provide prevention or reduction of motion, e.g. braking, pinning, wedging, stopping, retarding, and the like, while also providing an electrical connection. The mechanisms often have a shorter life span than the intended life span of the overall device they reside within, and as such, may contribute to the unreliability of the overall device. In order to increase overall device reliability, it is desirable to develop devices and mechanisms that have a greater functional life span. Moreover, it is desirable to reduce costs, simplify the design of complex devices, and facilitate serviceability and manufacturability of the devices. Collectively, exemplary embodiments described below address those issues.

Exemplary embodiments include an electrical interconnect, which may include a first contact portion and/or a second contact portion, capable of electrically biasing a member, such as a shaft or a shroud, and/or sensing the bias of a member, such as a shaft or a shroud, and assuring high reliability within the electrical contact function. Exemplary embodiments also include electrical interconnects integrated with bushings or bearings and capable of providing a snap-together assembly, as well as a self-loading and self-retaining function.

Exemplary embodiments provide various advantages. For example, because exemplary embodiments provide an electrical interconnect integrated with a bushing or bearing, those exemplary embodiments provide advantages over devices that provide a separate bushing or bearing and a separate electrical interconnect. For example, not only can the integrated interconnect apply electrical functions, the integrated interconnect also can mount mechanical devices and allow the devices to move, e.g., rotate, open, or close. Moreover, because exemplary embodiments of the integrated interconnect generally include fewer parts when compared with related art devices which require a device for applying an electrical bias and a separate device for mechanically mounting the member, these exemplary embodiments of the integrated interconnect allow for fewer overall individual parts and lower inventories as well as a simplified manufacturing assembly process and a simplified servicing process.

The following detailed description describes exemplary embodiments of apparatus, methods and systems for a multi-functional electromechanical integrated interconnect, sensor, and mounting, and a method of mounting and electrically biasing and/or sensing the electrical bias of a member. For the sake of clarity and familiarity, specific examples of electrical and/or mechanical devices and mechanisms for a printer and/or copier are given. However, it should be appreciated that the principles outlined herein can be equally applied to any electrical and/or mechanical device. For example, the principles may be applied to electric motors and generators.

Some related art Xerox® copiers, e.g., model no. 5065, employ a carbon fiber polymer composite electrical contact which is used to apply a high voltage bias to developer rolls. The electrical contact includes a relatively short rod that is formed of carbon fibers in a polymer composite. The carbon fiber polymer composite may be similar to that known by the trade name CarbonConX™. Related art Xerox® copiers, e.g., model no. 5800, employ a flat-shaped carbon fiber polymer composite electrical contact which is used to apply high voltage biases to various members of an electrostatic brush cleaner assembly. In related art Xerox® copiers, the rod acts as a sliding electrical contact or a slip rod-type electrical contact and is configured to be in tangential contact with the end shafts of two developer rolls. An end of an element attached to the center of the sliding contact is attached to a high voltage power source. The electrical contact and the element form the charge transfer device, which transfers charge from the voltage source to the developer rolls.

FIG. 1 illustrates an exemplary embodiment of a developer unit including a charge transfer device. The developer unit 100 may be used in a copier or printer, such as a Xerox® model no. 5065 copier. The developer unit includes a charge transfer device using an electrical contact to transfer electrical bias to a developer roll within the developer unit. The charge transfer device 105 is shown mounted to the developer unit 100. The charge transfer device 105 may transfer an electrical charge from a voltage source 120 to the developer rolls 110 and 115. The charge transfer device 105 may be mounted to a developer housing 125.

The charge transfer device 105 includes an electrical contact 130 that includes a first contact area 135 for contact with an element 140 and a second contact area 145 located on the periphery 150 of the electrical contact 130. The second contact area 145 establishes contact with the first development roll 110 and the second development roll 115 through the respective end shafts of the development rolls. Because the shafts and the electrical contact are capable of sliding with respect to each other, the contact is considered a sliding contact.

The electrical contact 130 includes a multiplicity of electrically conductive carbon fibers 155 extending in a substantially parallel direction. The electrically conductive carbon fibers 155 extend parallel to longitudinal axis 160 of the electrical contact 130.

As is known in the art, the environment inside typical printers and copiers is generally considered to be dirty and harsh towards electrical and mechanical contacts. The environment generally includes toner, dust, ozone, nitrogen oxides, water vapor, heat, and silicon oil, which may corrode and/or hinder the performance and reliability of the electrical and mechanical contacts. The machine may also induce mechanical vibration or mechanical impact to the electrical contact. For example, metallic electrical contacts, such as bent metal clips and the like, can react adversely with the internal printer environment, and may squeak, squeal, or cause unwanted acoustical noise, or even suffer severe mechanical abrasion and wear.

Using carbon fibers to transfer the electrical charge provides advantages over related art metal contacts. Carbon is less reactive to many substances found in internal printer and copier environments. Moreover, as is known in the art, the electrical contact must be applied to the member that is to receive the electrical bias with a sufficient mechanical force to adequately transmit the charge. The force required to transmit a charge from an electrical contact made of mostly carbon fibers to a member, such as, e.g., a developer roll, is relatively low, e.g. 20-50 grams, in comparison to related art contacts made of mostly metal, which may require forces as great as 100 grams. Other advantages that may be achieved by using carbon fibers include that unlike metal contacts, the carbon fiber electrical contact does not squeak or produce significant audible noise and is not prone to severe mechanical abrasion or wear.

The charge transfer device 105 shown in FIG. 1 uses a carbon fiber polymer composite. A carbon fiber polymer composite electrical contact may be formed of a large concentration of continuous length, high strength, conductive, carbon fibers (e.g., 50% or greater). The percentage of carbon fibers in the carbon fiber polymer composite is a factor in determining properties, e.g., resiliency, conductivity, strength, etc., of the carbon fiber polymer composite. Similarly, the percentage of other materials in the carbon fiber polymer composite, such as, e.g., polymer or plastic, will also affect the properties of the carbon fiber polymer composite. Because the electrical contact 130 is formed of a carbon fiber polymer composite, and as discussed above, carbon is, generally, non-reactive with many of the substances found in the typical printer environment, the electrical contact 130 provides the advantages of a longer service life and greater reliability over traditional metal contacts in the harsh and dirty printer environment.

However, the charge transfer device 105 and electrical contact 130, as shown in FIG. 1, are provided only to apply electrical biasing to the shafts of the development rolls. That is, the electrical contact 130 is provided only for electrical interconnect. A bushing or a bearing (not shown) is required for structural support of the development shafts. Thus, the electrical contact 130 does not provide substantial structural support of the development shafts. The force exerted against the shaft by the electrical contact is, generally, merely enough to enable a sufficient electrical interconnect between the electrical contact 130 and the shaft.

For structural support, the development shafts are each supported by a bushing or bearing (not shown) within which each respective development shaft is mounted. In the embodiment shown in FIG. 1, each development shaft is supported by a conventional ball bearing or alternately by a plastic bushing, such as Rulon® or Delrin®. Rulon® is the Saint Gobain Performance Plastics tradename for a family of self-lubricating, reinforced proprietary PTFE compounds and Delrin® is an acetal resin manufactured by DuPont. The bushing retains the shaft while the charge transfer device 105 applies an electrical bias to the shaft through the electrical contact 130. The bushing does not provide an electrical interconnect through which an electrical bias can be applied to the development shaft or sensed from the development shaft.

Exemplary embodiments according to this disclosure provide apparatus, systems and methods that may apply a bias to a member such as, a development roll, and may sense the electrical bias of the member. Moreover, exemplary embodiments provide an integrated electrical interconnect that may be (1) used for electrical biasing and/or sensing an electrical bias of a member, (2) act as a bushing or bearing component to allow for movement or rotation of the member, and (3) act as a structural mounting for the element thereby providing a mounting and locating function for the element. As such, the electrical interconnect may provide, independently or in combination, the electrical biasing of a member, the sensing of the electrical bias of a member, and the structural support of a member, e.g., the mechanical load bearing support of the member. The structural support provided by the interconnect may represent the full load support, in other words, the electrical contact can support 100% of the load, or only a portion of the load if a separate bushing or bearing is provided to support the remaining portion of the load. Moreover, the load can be of any of a variety of load types, such as, e.g., static or dynamic, sliding, etc.

Figure 2:
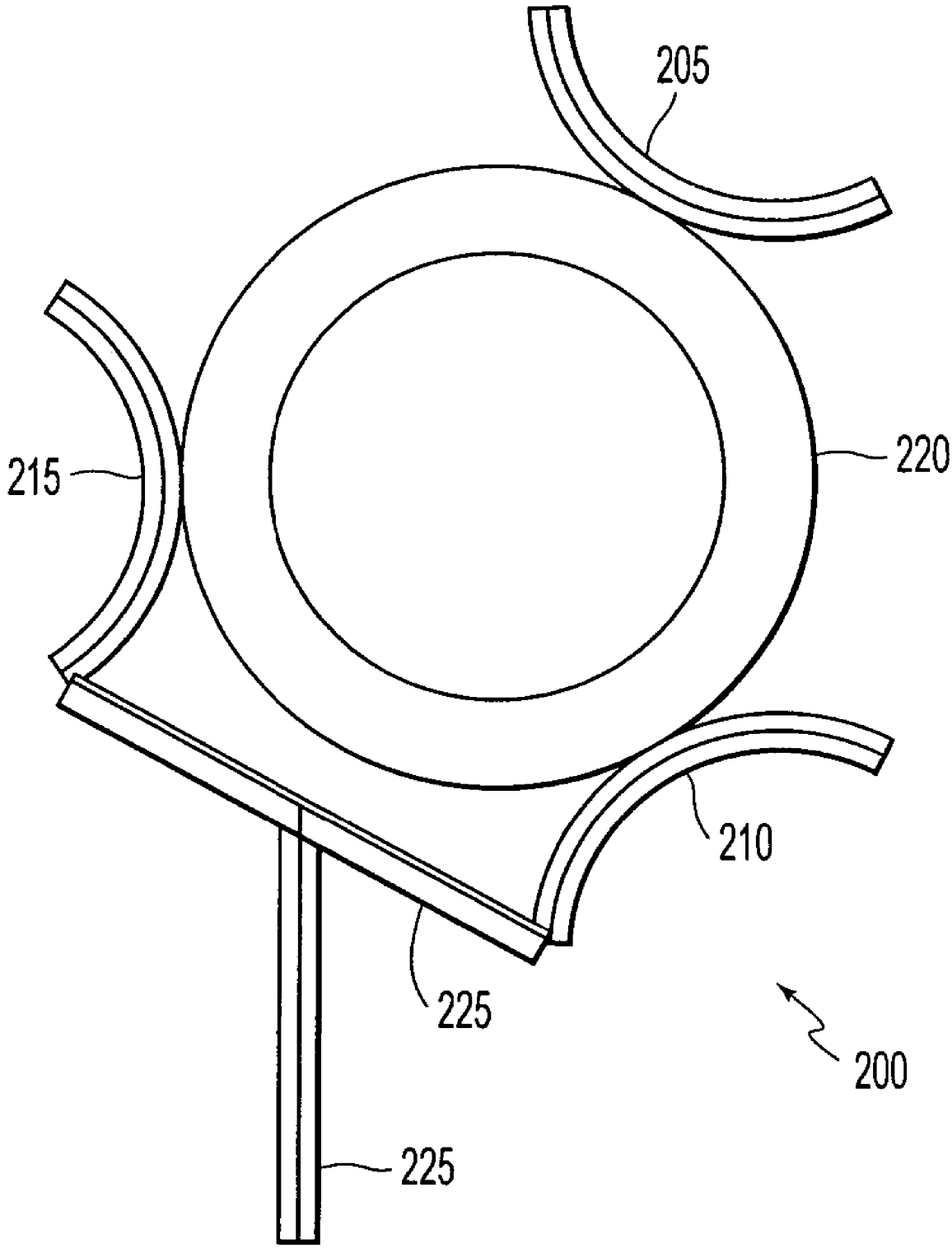
FIG. 2 illustrates a first exemplary embodiment of an interconnect capable of providing electrical bias to and/or sensing electrical bias, and providing mechanical load support to a member.

FIG. 2 illustrates an exemplary embodiment of an interconnect 200 including contact members 205, 210 and 215. The contact members are positioned in tangential contact with the shaft 220. The contact members 205, 210 and 215 may form electrical contacts and/or provide mechanical load support for the shaft 220, and have an arcuate form, hereinafter called a leaf spring-type configuration. The leaf spring-type arrangement of the contact members provides great strength for mechanical load support. In such a configuration, the contact members may provide electrical contacts to electrically bias the shaft and/or sense an electrical bias of the shaft, as well as position and/or restrict movement of the shaft.

If the contact members are used to provide mechanical load support, the mechanical load support may be affected by factors such as the size and shape of the support, its material and composition, and the degree of deflection of the contact members. The degree of deflection of the contact members 205, 210 and 215 is controlled by the area of the contact points (not shown), along with other factors, e.g., concentration of carbon fibers, the ingredients of the polymer matrix composite, etc. A mathematical model may be developed to enable optimization of these parameters by quantification of the interactions of contact load, force, and deflection as a function of the contact configuration, geometry, concentration of carbon fibers and the ingredients of the polymer matrix. In brief, the bending modulus and moment of inertia of the contact member affects the amount of deflection of the contact for any given load. Since increased loads and decreased modulii and moments increase deflection predictably, one can use these few parameters to design the desired deflection in the contact element(s).

In the exemplary embodiment shown in FIG. 2, at least one of the contact members may serve the voltage application function, e.g., biasing, and at least one of the contact members may serve a voltage sensing function, e.g., provide for direct readout of the electrical bias effected upon the shaft. For example, contact members 210, 215 may serve to apply an electrical bias to the shaft 220. Contact member 205 can serve to sense the voltage effected upon the shaft 220. Contact members 210, 215 are electrically connected to a common member 225, which is connected to a voltage source (not shown). The contact members 205, 210, 215 are disposed about the shaft 220 such that the contact members 210, 215 that provide an electrical bias to the shaft are separated and not in electrical contact with the contact member 205 that is provided to sense the electrical bias of the shaft 220, except for any electrical connection formed through the 220 shaft itself. In addition, the sensing member 205 may be configured to sense other parameters, e.g. mechanical vibration, temperature, etc. in addition to applied voltage. In other words, the sensor may be a multifunctional sensor and be capable of sensing more than one parameter.

Exemplary embodiments may be applied in a broad range of fields. For example, the shaft 220 may be a shaft in a printer, e.g., a development roll shaft. As discussed above, it is necessary to bias the development roller in printing and copying processes. Thus, the shaft 220 may be electrically connected to a biasable member, e.g., a development roll (not shown). The shaft 220 could also represent a shaft in any of a range of products, such as, e.g., an electric motor or generator. In exemplary embodiments, the contact members 205, 210, and 215 may provide mechanical support to the shaft, electrical bias or ground to the shaft, and/or sense the electrical bias of the shaft.

Figure 3:
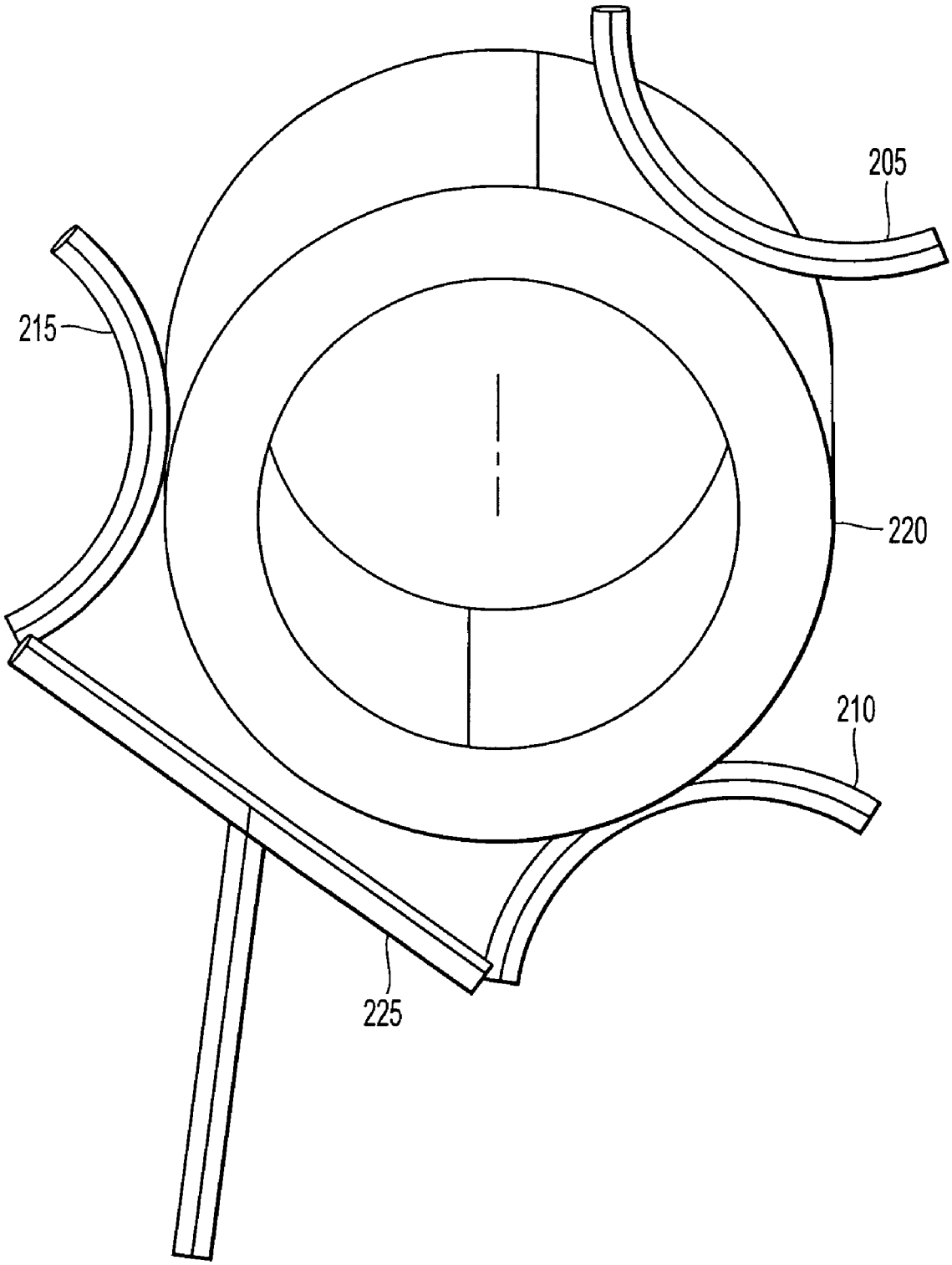
FIG. 3 illustrates a perspective view of the interconnect illustrated in FIG. 2.

FIG. 3 illustrates a perspective view of the exemplary embodiment illustrated in FIG. 2.

Figure 4:
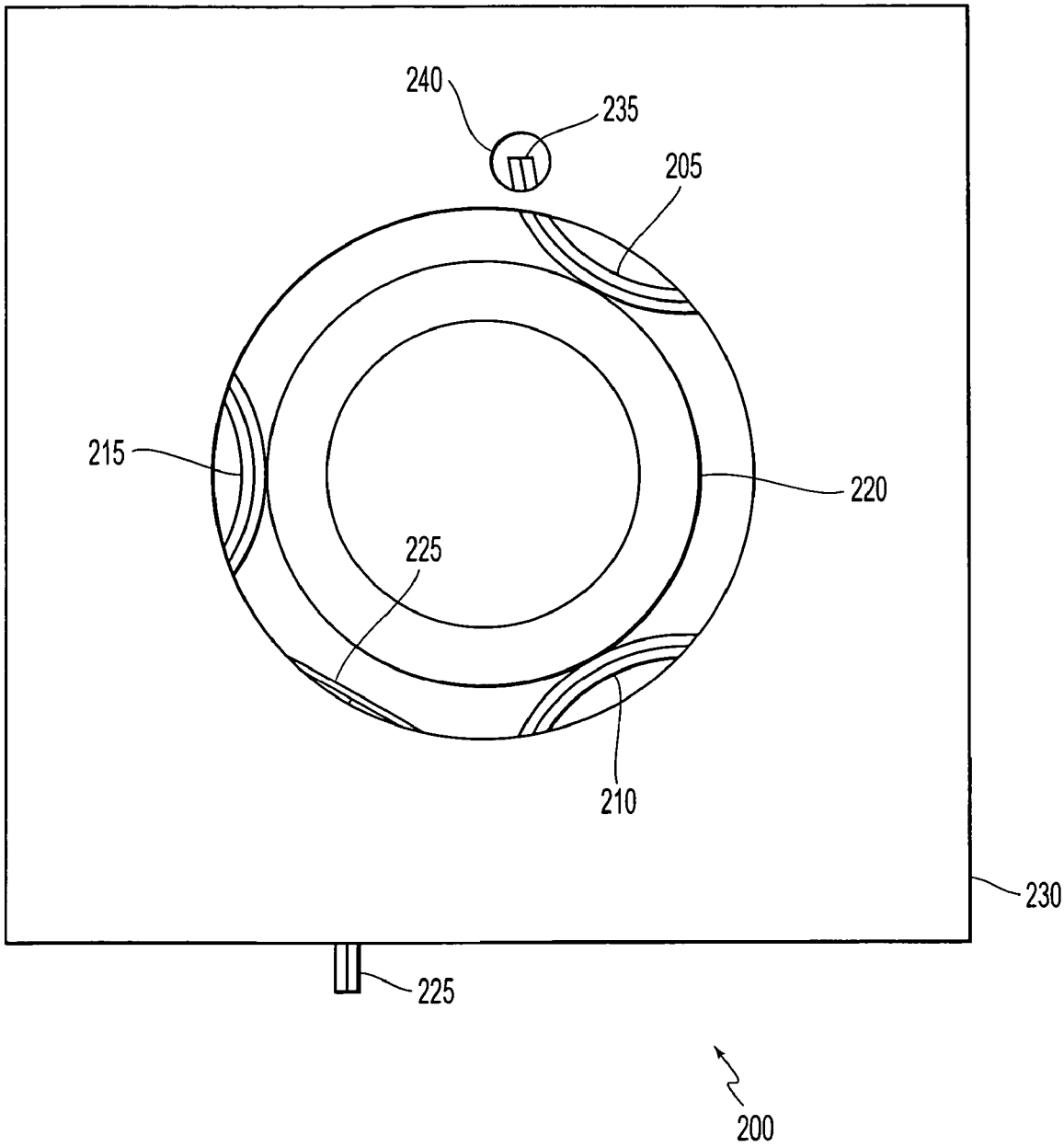
FIG. 4 illustrates a second exemplary embodiment of an interconnect capable of providing electrical bias to and/or sensing the electrical bias of a member.

FIG. 4 illustrates another exemplary embodiment of an interconnect 200. In FIG. 4, contact members 205, 210 and 215 are positioned in contact with the shaft 220 and are mounted in a housing 230. Like the exemplary embodiment illustrated in FIG. 2, in FIG. 4, the contact members may be positioned in tangential contact with the shaft 220. The housing 230 may be removable to provide serviceability or may be a permanent, or sealed housing member of an integrated assembly.

Like the exemplary embodiment illustrated in FIG. 2, in FIG. 4, a contact member, e.g., contact members 210, 215, may provide the electrical contact to serve the voltage application function, while another contact member, e.g., contact member 205, may provide the electrical contact to serve the voltage sensing function, e.g., serve to sense the voltage effected upon the shaft 220.

In exemplary embodiments, the sensing electrical contact, e.g., contact member 205, may be configured to provide direct and temporary contact to a service meter used by a field technician or service representative. For example, the end 235 of the contact member 205 can extend through a hole 240 in the housing 230. A field technician can connect a service meter to the end 235 of the contact member 205 to meter the electrical potential of the contact member. Thus, the end of the sensing electrical contact 235 and/or hole 240 in the housing 230 may act as a test point for a field technician to measure the electrical potential of the shaft 220.

While the above exemplary embodiments have described the contact members 205, 210, 215 as a conductive plastic made of carbon fibers and a host polymer resin, the contact member may include other electronics and/or circuitry. For example, electronics for AC to DC rectification may be included in the contact member. Similarly, resistors, signal processors, filters, capacitors, integrated circuits, e.g. ICs, and diodes, alone or in any combination, may be included within the contact member. Moreover, as discussed below, other materials, such as lubricants, either solid or liquid, may be added to the contact member to provide additional features.

For example, if the shaft 220 supports a development roll within a printer, the development roll may have an electric potential of approximately 500 to 5,000 volts. Due to safety concerns, a field technician may want to avoid testing the contact member 205, without adding a circuit to the contact member 205 to reduce the readout voltage or limit the current flow within the sensing circuit or external circuit. As such, a circuit may be included in the contact member 205, including a voltage divider or transformer for example, in order to reduce the measured voltage of the development roll, i.e., through the shaft 220, as measured by a meter used by the field technician. Moreover, by including circuitry within the contact member, the technician can avoid the time and expense of having to provide additional circuitry, such as a sensor and processor, to the end 235 of the contact member 205 in the field, in order to measure the electrical potential of the contact member 205. Alternatively, the end of the sensing electrical contact 205 can be configured to provide a permanent monitor and control feature which may include, for example, a digital meter or illuminated display readout.

Figure 5:
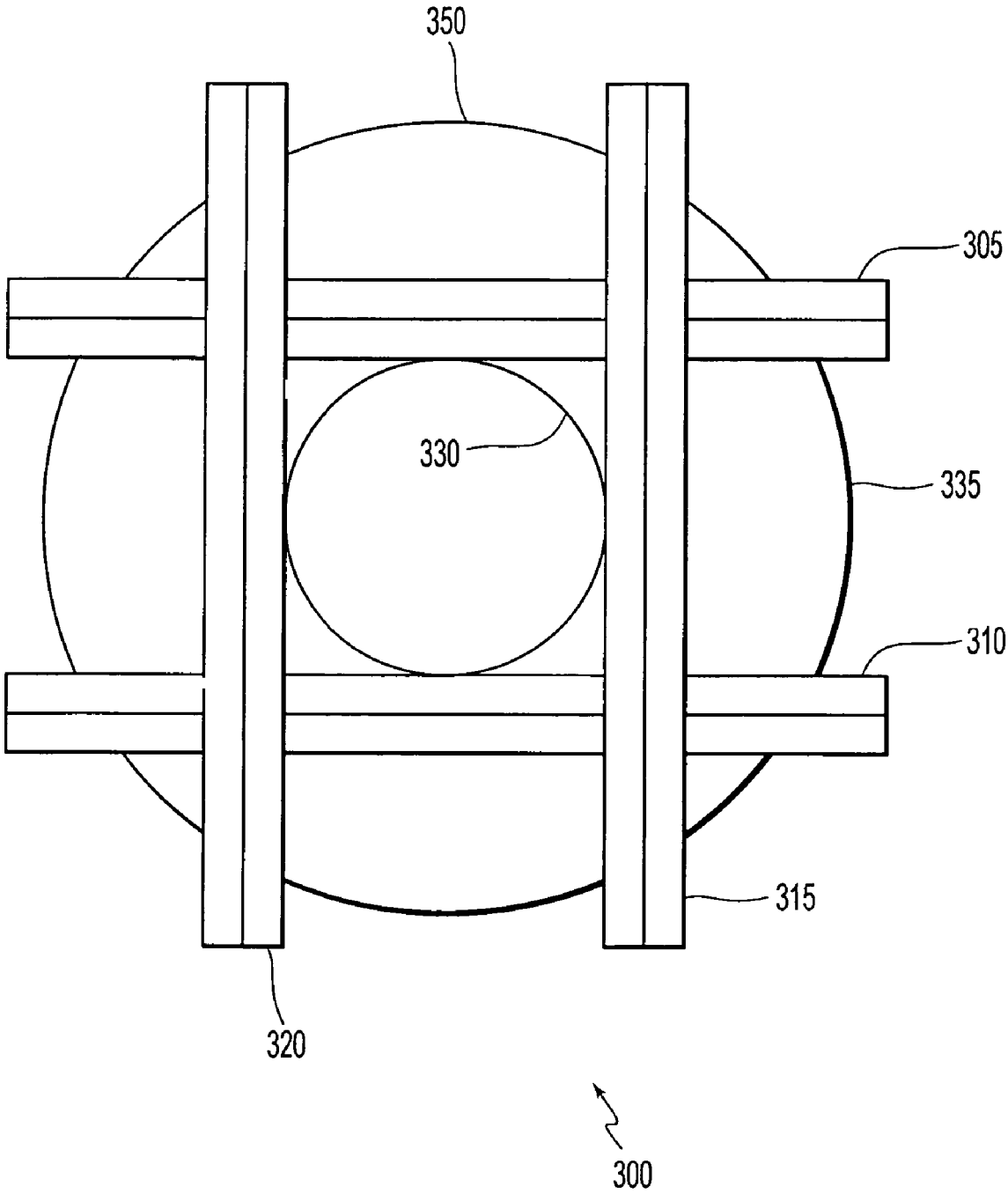
FIG. 5 illustrates a third exemplary embodiment of an interconnect capable of providing electrical bias to and/or sensing the electrical bias of a member.

FIG. 5 illustrates an exemplary embodiment of an electrical interconnect 300 including contact members 305, 310, 315 and 320 provided adjacent to shaft 330. In the exemplary embodiment shown in FIG. 5, contact members 305, 310, 315 and 320 are not intended to provide substantial structural support to the shaft 330. Instead, the shaft 330 is supported by a bushing or a bearing (not shown).

In FIG. 5, the contact members 305, 310, 315 and 320 maybe used to apply an electrical bias to a member, e.g., shaft 330, and/or sense the electrical bias of the member. In FIG. 5, two contact members, e.g., contact members 305, 310, can be used to electrically bias the shaft 330, while the remaining two contact members are electrically isolated from the other contact members, e.g., contact members 315, 320, may be used to sense the electrical bias of the shaft 330. As such, in the embodiment shown in FIG. 5, the contact members be used collectively to electrically bias and sensing the electrical bias of the shaft 330. The shaft 330 may be subdivided into electrically isolated areas (e.g., sectors) wherein the contact members, for example 305 and 310, may be used to apply different biases to the segmented shaft and sensing members 315 and 320 may be used to sense different voltages (or other parameters) on representative sectors. The shaft 330 supports a roll 350, e.g., a development roll of a photocopier.

Figure 6:
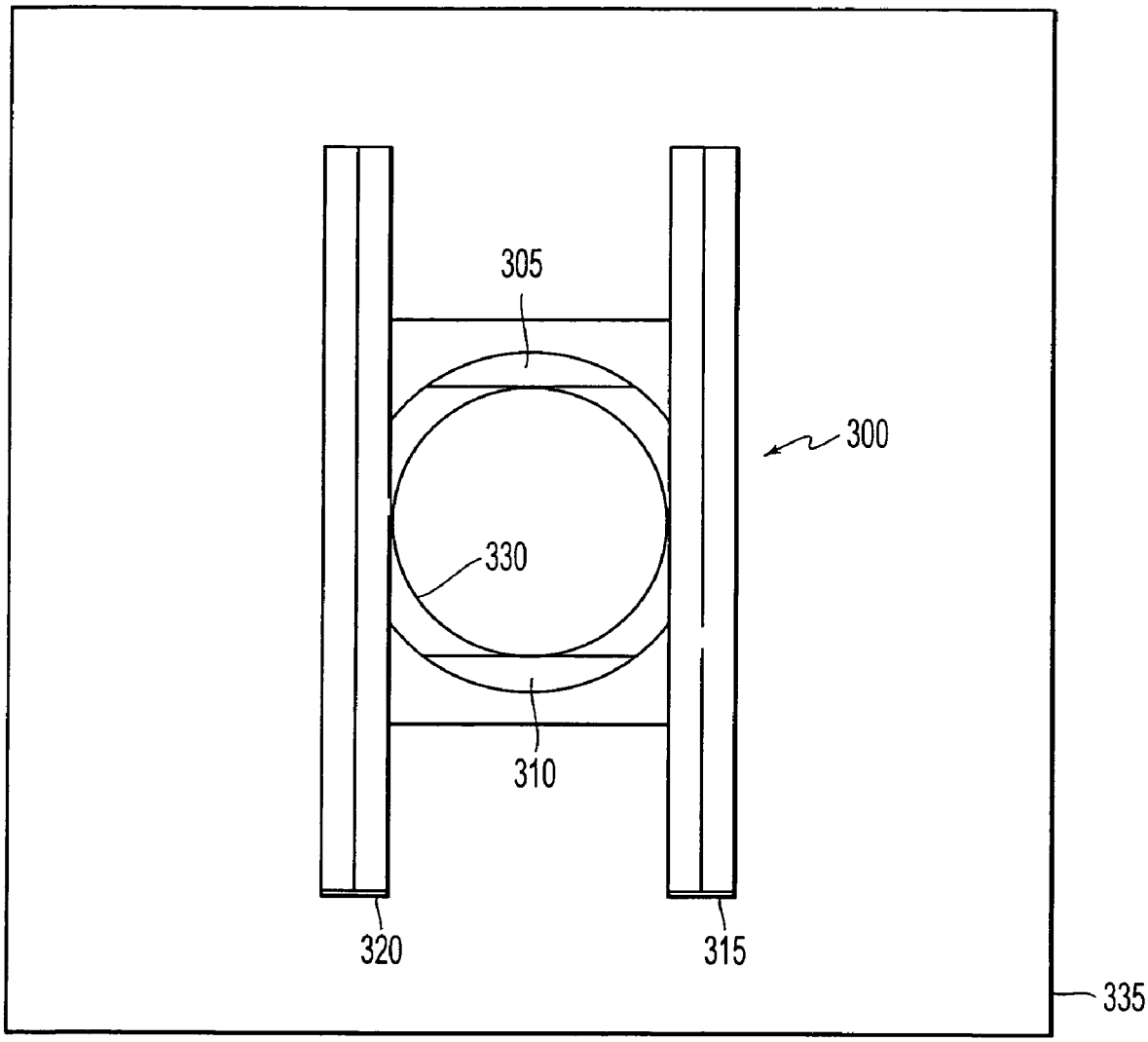
FIG. 6 illustrates a fourth exemplary embodiment of an interconnect capable of providing electrical bias to and/or sensing the electrical bias of a member.

FIG. 6 illustrates an exemplary embodiment in which the contact members 305, 310, 315 and 320 are provided about the shaft 330 and are separated from each other by a plastic housing 335. As in exemplary embodiments discussed above, the contact members dedicated to electrically biasing a member may be isolated from the contact members dedicated to sensing the electrical bias of the member. Moreover, as in exemplary embodiments discussed above, the housing 335 may be integrated as part of a larger housing, or preformed, inserted, and mounted in a larger housing. The housing can be formed and molded to provide receptacles for the contact members such that the contact members can be snapped or easily placed into the receptacles. The housing and contact members may be replaceable. A replaceable housing and contact members provide advantages, such as, e.g., easy serviceability of the housing and/or the contact members by a field technician. Alternately, the housing may be manufactured by suitable fabrication process to be a non-separable element, for example by insert or liquid cast molding, and thereby seal the contact members providing an additional degree of resistance to harsh environmental factors.

Figure 7:
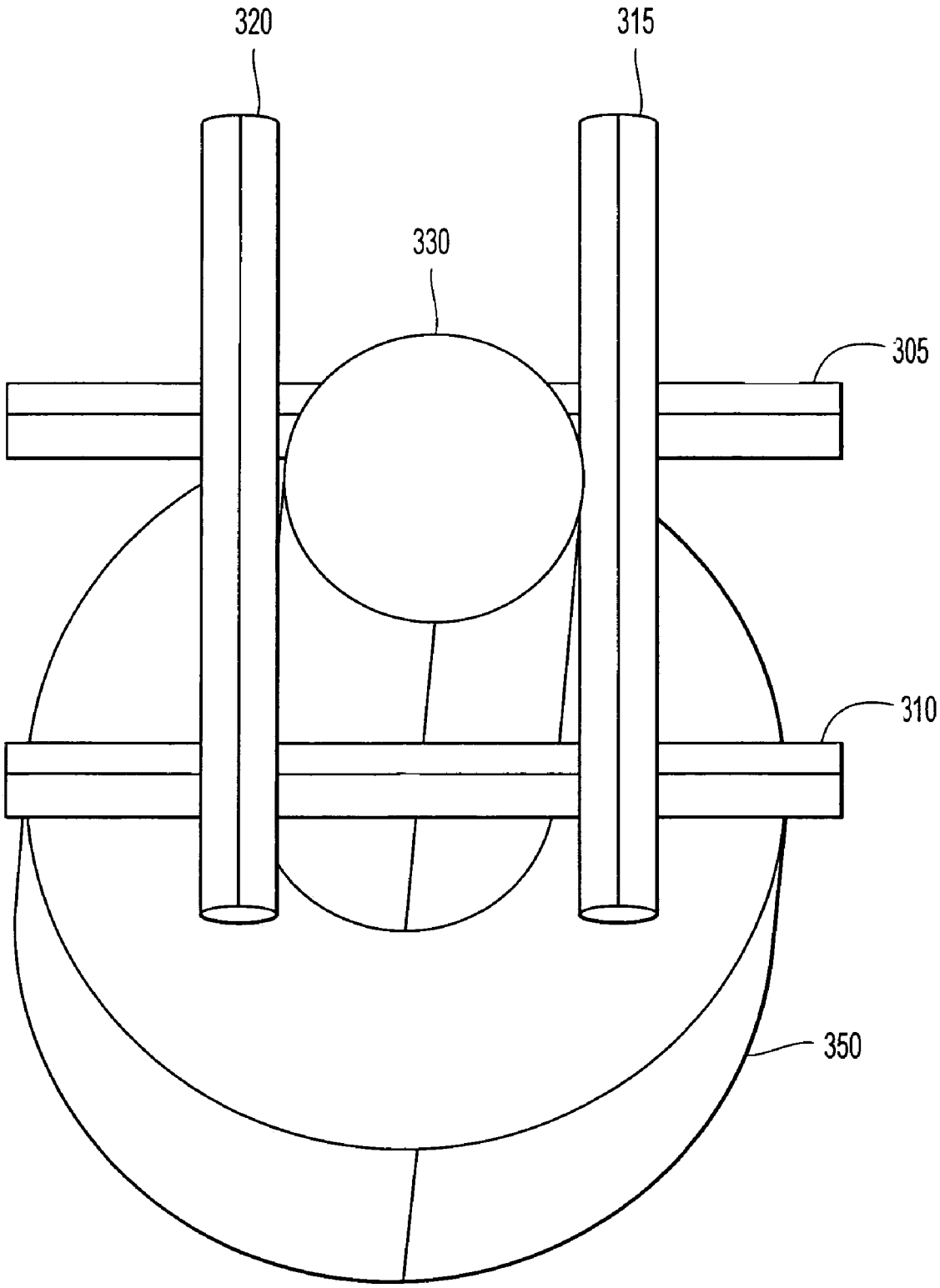
FIG. 7 illustrates a perspective view of the interconnect of FIG. 5.

FIG. 7 illustrates a perspective view of the interconnect of FIG. 5.

Figure 8:
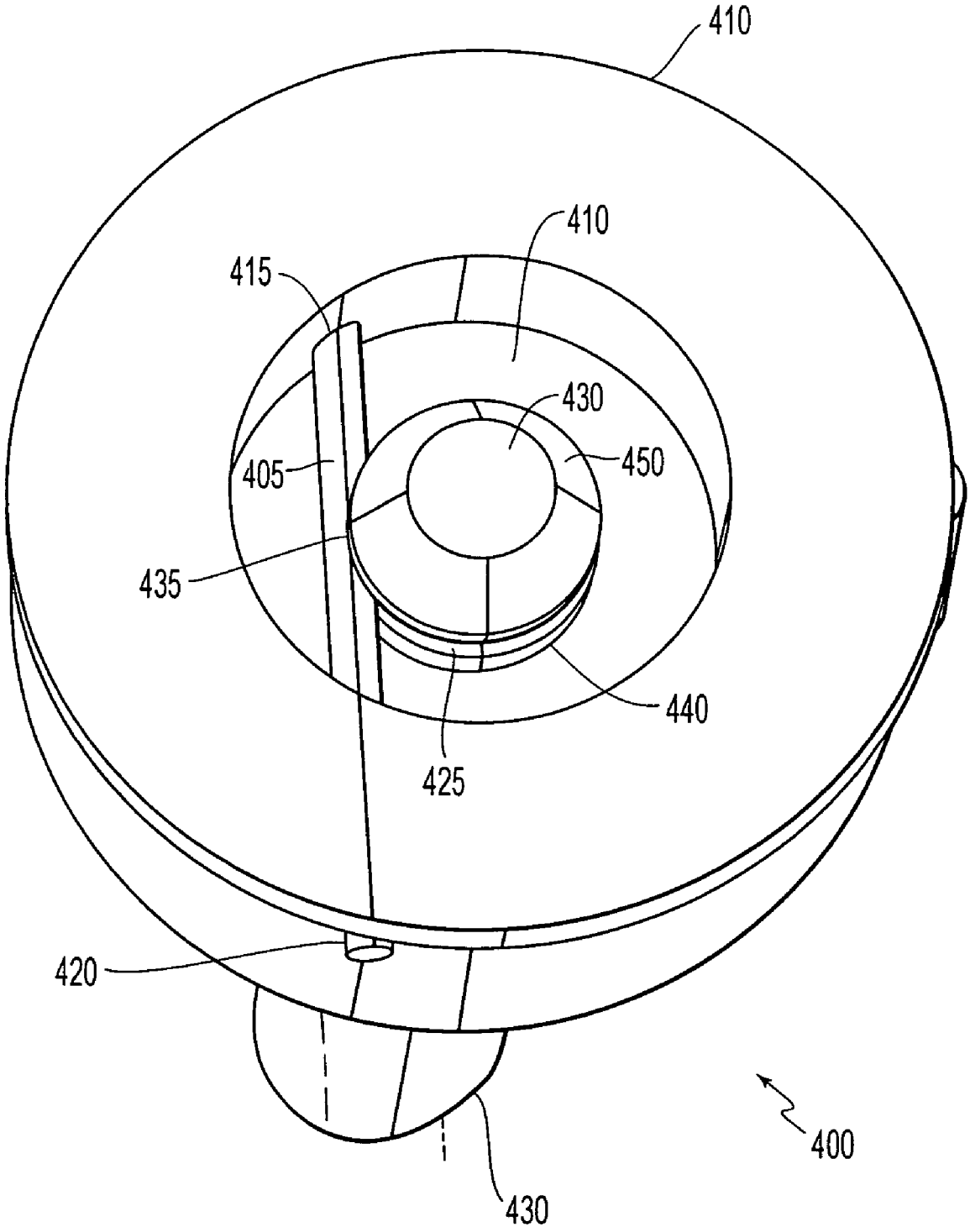
FIG. 8 illustrates a perspective view of a fifth exemplary embodiment of an interconnect capable of providing an electrical bias to and/or sensing the electrical bias of a member, and capable of restraining movement of the member.

FIG. 8 illustrates a perspective view of another exemplary embodiment of an interconnect 400. Interconnect 400 includes contact member 405 which intersects a support member 410 at point 415 and exits the support member 410 at point 420. The support member 410 may be, for example, a bushing or a bearing. The contact member 405 has a portion that is aligned tangentially relative to a part of the shaft 430 protruding from the support member 410. A circumferential groove 425 is provided in shaft 430. The contact member 405 is located such that it can be inserted into and rest in the groove 425 of the shaft 430. In the exemplary embodiment shown in FIG. 8, approximately one-half of the circumference of the cross-section of the contact member 405, taken in a plane parallel to the shaft 430, is recessed in the groove 425 of the shaft 430; however, in other exemplary embodiments more or less than one-half of the circumference may be recessed in the groove 425.

The shaft 430 is mounted in the support member 410. The support member 410 supplies a mounting surface for the shaft 430 and allows the rotation of the shaft 430. The support member 410 locates and holds the contact member 405 at the locations (e.g., point 415) where the contact member is embedded in the support member 410. The contact member 405 may be embedded in the support member 410 when the support member 410 is formed during a molding process, or may be subsequently inserted into the bushing 410. The support member 410 has an inner and outer circumference. The shaft 430 mounts and rotates within the inner circumference. The outer circumference of the support member 410 may be used to mount the support member 410 into a housing (not shown). The housing may have a mating electric contact (not shown) by which the contact member 405 may connect with a voltage supply (not shown).

The groove 425 may provide a self-aligning, self-loading, self-retaining, and snap-together assembly of the shaft 430, the support member 410, and the contact member 405. Self-aligning refers to an assembly feature where two or more parts can be mutually joined with little, or no, pre-alignment required to achieve the desired junction. Self-loading and self-retaining refer to features of a joined pair of parts wherein a desired force is established therebetween which serves to maintain the parts in mutual contact. Snap-together refers to one or more features included within the interface of two or more parts that enable the parts to snap into the desired mating position and fit tightly together. Thus, because the contact member 405 is integrated with the support member 410, the contact member 405 can be snapped into the groove 425 to provide self-retaining, self-loading, and snap-together assembly features once the shaft 430 is inserted into the support member 410. For example, support member 410 may be preformed with a receptacle (not shown) to receive contact member 405, and a receptacle (not shown) to receive shaft 430. Contact member 405 may be inserted into the receptacle (not shown), e.g., at point 415. After the contact member 405 has been inserted into the receptacle (not shown), a force may be applied to a portion 435 of the contact member 405, to slightly deform the contact member 405 and force the portion 435 of the contact member 405 away from the shaft 430. After the contact member has been slightly deformed, shaft 430 may be inserted into another receptacle (not shown) that was preformed in support member 410 at, e.g., point 440. Once the circumferential groove 425 part of the shaft 430 reaches portion 435 of contact member 405 during the insertion process, the force on the contact member 405 may be released. Upon release, the portion 435 of contact member 405 is located within the circumferential groove 425 of the shaft 430. The interaction between the shaft 430 and the contact member 405 prevents the shaft 430 from substantial movement in a direction, at least, parallel to the longitudinal axis of the shaft 430.

Figure 9:
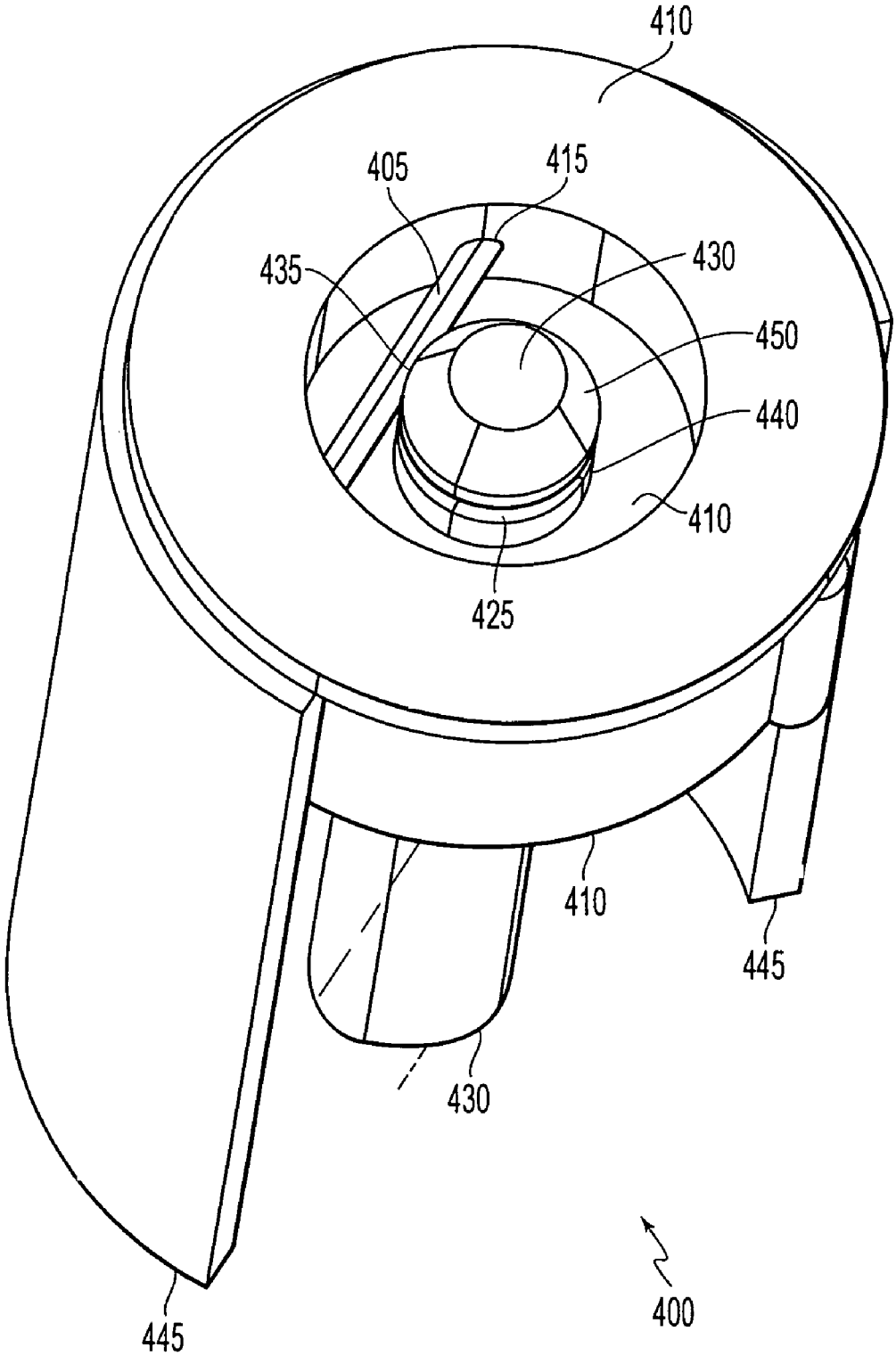
FIG. 9 illustrates a perspective view of a sixth exemplary embodiment of an interconnect capable of providing an electrical bias to and/or sensing the electrical bias of a member and capable of restraining movement of the member.

For example, the self-loading, self-retaining, and snap-together assembly features of the shaft 430, support member 410 and contact member 405 are illustrated in FIG. 8 and FIG. 9. For example, contact member 405 may be integrated with the support member 410. The shaft 430 may include a groove 425 and a beveled end 450. The shaft 430 can be inserted through a hole 440 of the support member 410. After the beveled end 450 of the shaft 430 passes through the hole 440, the beveled end 450 may contact and apply a force to contact member 405. As the shaft 430 continues to be further inserted through the hole 440, the contact member 405 at, e.g., portion 435, will be deflected and slide past the end of the shaft 430. When the contact member 405 reaches groove 425 of the shaft 430, the contact member 405 snaps into the groove 425. The contact member 405 interacts with the shaft 430 at the groove 425 to retain the shaft 430 from substantial movement in a direction parallel to the longitudinal access of the shaft 430.

As discussed above, the shaft 430 applies a force to the contact member 405 during the insertion process. As this force is applied to the contact member 405, portions of the contact member, e.g., portion 435 and the end portions of the contact member 405 embedded within the support member 410, experience pressure, such as compression and/or tension and may respond by bending at the point of maximum pressure, e.g. at location 435. Once the contact member 405 travels across the beveled end 450 of the shaft 430 and into the groove 425, at least a portion of this pressure is released and the bend within the contact member 405 may recover or be reduced to a lesser extent. The release of the pressure in this manner allows the contact member 405 to snap into the groove 425 and retain the shaft 430 under a sufficient contact force to provide sufficiently low contact resistance such that the contact element is good electromechanical contact with the shaft 430 and can thereby provide reliable electrical interconnection therebetween.

The self-loading, self-retaining, and snap-together assembly features of the shaft 430, support member 410, and contact member 405 provide improvements over manufacturing and serviceability processes that require both additional assembly steps and additional elements to retain the shaft. The self-loading, self-retaining, and snap-together assembly features allow for relatively quick serviceability of the shaft 430 and contact member 405. For example, a field technician may remove the shaft 430 by applying a force to portion 435 of contact member 405 such that the contact member 405 is deformed and is removed from circumferential groove 425. The shaft 430 could then be removed from support member 410 in a direction parallel to the shaft's axis, whereupon the force upon the contact member 405 can be released. The shaft 430 can then be replaced, e.g., by following steps similar to those outlined above.

A cap (not shown) maybe provided over the support member 410 to cover the contact member 405 and the shaft 430.

FIG. 9 illustrates a perspective view of another exemplary embodiment illustrating an interconnect 400. FIG. 9 is similar to the exemplary embodiment illustrated in FIG. 8; however, FIG. 9 includes a shroud 445. In FIG. 9, contact member 405 is embedded in support member 410 and placed in tangential contact with a part of the shaft 430 protruding from the support member 410. The contact member 405 is placed in groove 425 of the shaft 430 to provide the self-loading, self-retaining, and snap-together assembly features discussed above. An end of the contact member 405 (e.g., end point 420, as shown in FIG. 8) is placed in contact with the shroud 445. Thus, the contact member 405, which is embedded in support member 410, is placed in contact with both the shaft 430 and the shroud 445.

As in the exemplary embodiments discussed above, one end of the contact member may be configured to mate with a high voltage power supply or a meter test point. By placing the contact member 405 in contact both the shaft 430 and the shroud 445, the contact member can be used to do one or more of the following: (1) electrically bias both the shaft 430 and the shroud 445, (2) sense the electrical bias of the shaft 430 and the shroud 445, and (3) provide one electrical function to the shaft, and another electrical function to the shroud. Similarly, by placing the contact member 405 in contact with both the shaft 430 and shroud 445, an electrical charge can be transferred from the shroud 445 to the shaft 430, or from the shaft 430 to the shroud 445, such as to control the electrical bias of the shaft 430 in relation to the shroud 445.

Figure 10:
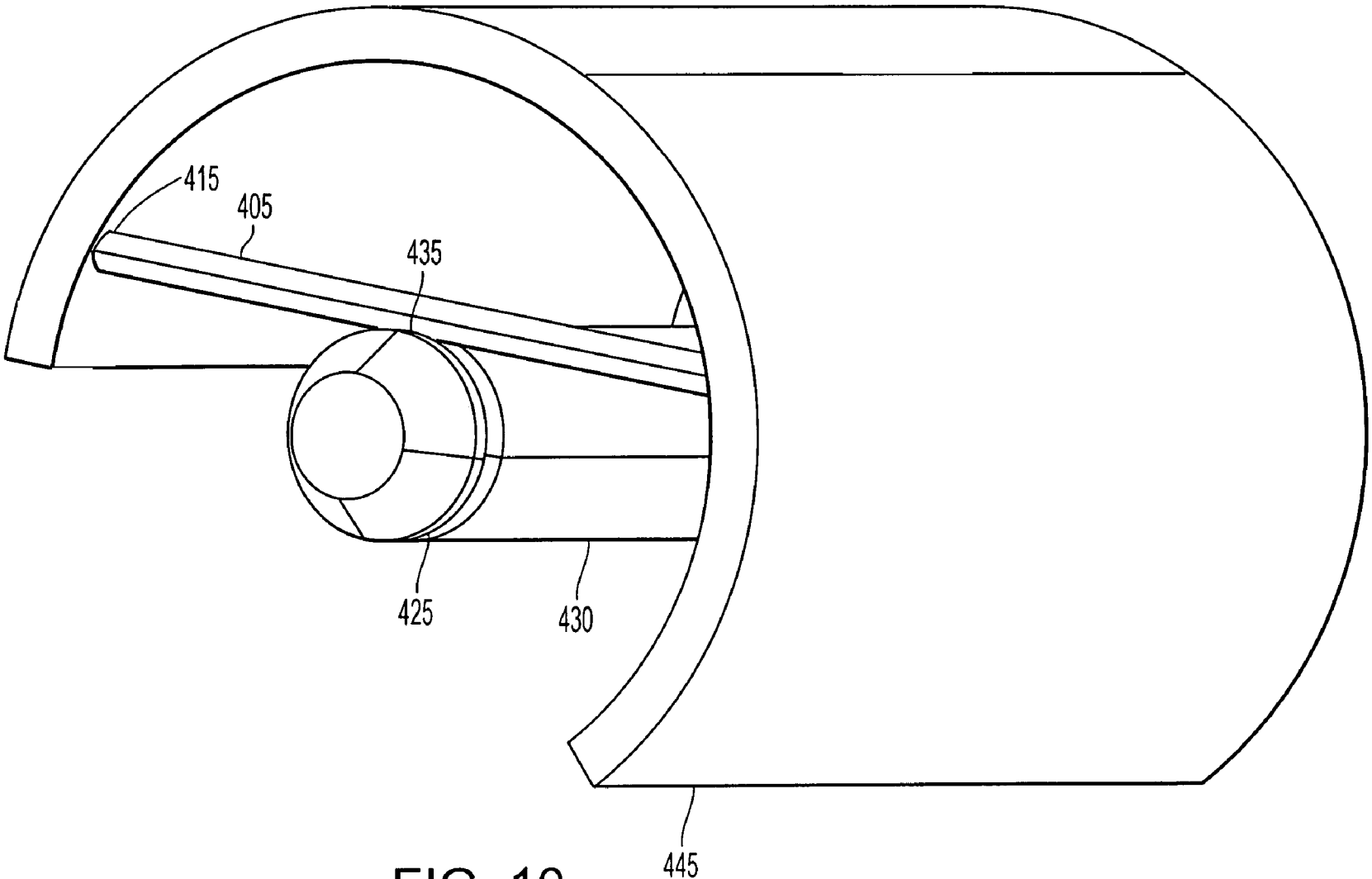
FIG. 10 illustrates a perspective view of the interconnect of FIG. 9.

FIG. 10 illustrates a perspective view of the interconnect of FIG. 9. In FIG. 10, the support member has been removed for clarity.

As discussed above, exemplary embodiments provide a contact member formed out of a material including carbon fibers. This composition allows the contact member to be formed in virtually any shape, e.g., a rod, tube, bar, sheet, etc. Thus, it should be appreciated that the contact member may have any shape and configuration capable of performing an electrical function, e.g., transferring an electrical potential from one member to another member. Moreover, because the contact member can have any shape, it can be adapted to fit in any desired location within a copier, printing machine, or other electrical device, in which electrical transfer is necessary.

As discussed above, the percentage of a specific ingredient, such as, e.g., carbon, polymer, lubricant, catalyst, filler, etc., in a contact member may be manipulated to provide the contact member with specific properties. Thus, the contact member should be designed for the specific feature(s) it will provide in a device. That is, if the contact member is to provide an electrical circuit and mechanical features, the contact member should be designed to optimize the electrical circuit and the mechanical requirements. For example, the spring constant of the contact member may be optimized to provide the self-loading, self-retaining and snap-together features discussed above. As is known in the art, the spring constant of a component is controlled by its material, modulus, size and shape.

The external skin of the contact member should be tailored for both the electrical and mechanical functions of the member. For example, the skin of the contact member should provide for whatever degrees of movement are required of the contact member. Dry lubricants, such as graphite, bronze, molydenium, or metal powder, metal stearates, polytetrafluroethylene (PTFE), polyethylene, wax or combinations thereof, may be added to the polymer matrix composition to provide a contact member with a relatively low sliding friction, and/or to eliminate a bushing or a bearing. Carbon may be provided in the outer layer to provide lubrication, and resistance to corrosion and oxidation.

As discussed above, the specific ingredients and processing of the contact member composition (e.g., carbon fiber type, loading, orientation, polymer type, and cross link density) are selected to yield target electrical and mechanical properties that have been optimized for a particular application. In exemplary embodiments, metal, clay, silica, and/or other materials may be added to the composite to provide additional features to the contact members. Moreover, while exemplary embodiments use fibers made of carbon, other materials could be used in place of or in addition to carbon in the contact members.

In exemplary embodiments provided for a development shaft in a printer or copier, contact members may be formed of a carbon fiber pultrusion in a thermal set matrix, e.g., epoxy, where the outer layer, e.g., the skin of the contact member, is approximately 90% carbon. In exemplary embodiments, the carbon fiber may be retained in a thermoplastic or thermosetting polymer. In exemplary embodiments, the contact members may have diameters within the range of 0.07 to 1.2 mm. Diameters within this range provide sufficient contact pressure for many development roll shafts while also providing sufficient support to receive the rotary, normal, radial and thrust loads of the shaft. Naturally, for very large or for very heavy assemblies, the contact members can be appropriately larger and can have diameters, for example of many inches or even many feet. The length of the contact member is generally selected to be as compact as possible and to enable the assembly to be compact. It is understood however, that the length of the contact member can be any length, up to and including many meters or even kilometers and is generally selected to meet the specific requirements of the particular application. Likewise the shape of the contact can be any shape and can be uniform in shape or dissimilar in shape along its length, width, height, or diameter. Of course, the shape, length, and size, for example diameters, of the contact members are a function of the electrical conductivity desired at and within the contact and the specific load a contact member is intended to support.

While exemplary embodiments have been described as outlined above, these embodiments are intended to be illustrative and not limiting. Various changes, substitutes, improvements or the like may be made without departing from the spirit and scope of the invention.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An interconnect comprising a first contact portion, a second contact portion, and a member, the first contact portion capable of electrically biasing the member and including carbon fibers, the second contact portion capable of transferring an electrical bias of the member to a sensor and including carbon fibers, and the first contact portion and the second contact portion contacting the member, wherein the first contact portion and the second contact portion each provide a force greater than 10 grams which acts to structurally support the member.

2. The interconnect of claim 1, wherein the first contact portion and the second contact portion each provide a force greater than 50 grams which acts to structurally support the member.

3. The interconnect of claim 1, wherein the first contact portion and the second contact portion form an arcuate structural support.

4. The interconnect of claim 1, wherein one of the first contact portion or the second contact portion includes an electrical circuit for performing a function other than electrically biasing the member or transferring the electrical bias of the member to the sensor.

5. The interconnect of claim 1, wherein the first contact portion is connected to a voltage source.

6. The interconnect of claim 1, wherein the first contact portion and the second contact portion tangentially contact the member.

7. The interconnect of claim 1, wherein the first contact portion and the second contact portion are integrated into a support member, and the first contact portion, second contact portion, and the support member contact the member.

8. The interconnect of claim 1, wherein the first contact portion and the second contact portion are electrically connected to the member and are not directly connected to each other.

9. The interconnect of claim 1, wherein at least one of the first contact portion or the second contact portion is electrically connected to the member and a second member.

10. The interconnect of claim 1, wherein the member is capable of movement relative to the first contact portion and the second contact portion.

11. The interconnect of claim 1, wherein the first contact portion, the second contact portion and a third contact portion substantially prevent movement of the member in a radial direction of the member.

12. The interconnect of claim 1, wherein greater than 50% by weight of the first contact portion and greater than 50% by weight of the second contact portion is carbon fibers.

13. The interconnect of claim 1, wherein the carbon fiber is a component of a composite and is retained in a thermoplastic or thermosetting polymer.

14. The interconnect of claim 13, wherein the composite contains a metal.

15. A xerographic device including the interconnect of claim 1.

16. The interconnect of claim 1, wherein the sensor is a multifunction sensor capable of sensing more than one parameter.

17. The interconnect of claim 16, wherein the sensor is capable of sensing at least one of vibration, temperature and voltage.

18. An interconnect comprising a first contact portion, a second contact portion, and a member, the first contact portion capable of electrically biasing the member and including carbon fibers, the second contact portion capable of transferring an electrical bias of the member to a sensor and including carbon fibers, and the first contact portion and the second contact portion contacting the member, wherein the second contact portion includes the sensor.

19. A xerographic device including the interconnect of claim 18.

20. The interconnect of claim 18, wherein the sensor is a multifunction sensor capable of sensing more than one parameter.

21. The interconnect of claim 20, wherein the sensor is capable of sensing at least one of vibration, temperature and voltage.

22. The interconnect of claim 18, wherein the first contact portion is connected to a voltage source.

23. The interconnect of claim 18, wherein the first contact portion, the second contact portion and a third contact portion substantially prevent movement of the member in a radial direction of the member.

24. The interconnect of claim 18, wherein greater than 50% by weight of the first contact portion and greater than 50% by weight of the second contact portion is carbon fibers.

25. The interconnect of claim 18, wherein the carbon fiber is a component of a composite and is retained in a thermoplastic or thermosetting polymer.

26. An interconnect comprising a first contact portion, a second contact portion, and a member, the first contact portion capable of electrically biasing the member and including carbon fibers, the second contact portion capable of transferring an electrical bias of the member to a sensor and including carbon fibers, and the first contact portion and the second contact portion contacting the member, wherein the member contains at least two areas electrically isolated from each other.

27. A xerographic device including the interconnect of claim 26.

28. The interconnect of claim 26, wherein the sensor is a multifunction sensor capable of sensing more than one parameter.

29. The interconnect of claim 28, wherein the sensor is capable of sensing at least one of vibration, temperature and voltage.

* * * * *